US009492737B2

(12) United States Patent
Yu et al.

(10) Patent No.: US 9,492,737 B2
(45) Date of Patent: Nov. 15, 2016

(54) GAME ASSEMBLY COMPRISING A TOKEN SUBSTITUTE FEATURE AND A TOKEN STORAGE AND DISTRIBUTION SYSTEM

(71) Applicant: Mattel, Inc., El Segundo, CA (US)

(72) Inventors: Brian M. Yu, Culver City, CA (US); Jeffrey W. Bazarko, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/605,949

(22) Filed: Jan. 26, 2015

(65) Prior Publication Data

US 2015/0209657 A1 Jul. 30, 2015

Related U.S. Application Data

(60) Provisional application No. 61/933,240, filed on Jan. 29, 2014.

(51) Int. Cl.

| | |
|---|---|
| ***A63F 1/00*** | (2006.01) |
| ***A63F 11/00*** | (2006.01) |
| ***A63F 1/06*** | (2006.01) |

(52) U.S. Cl.

CPC ..... *A63F 11/0002* (2013.01); *A63F 1/06* (2013.01); *A63F 2011/0006* (2013.01)

(58) Field of Classification Search

CPC ..... A63F 11/0002

See application file for complete search history.

(56) References Cited

U.S. PATENT DOCUMENTS

| | | | |
|---|---|---|---|
| 504,996 | A | 9/1893 | Nuttle |
| 529,228 | A | 11/1894 | Wyler |
| 566,134 | A | 8/1896 | Buffat |
| 573,076 | A | 12/1896 | Drobisch |
| 722,359 | A | 3/1903 | Fowler |
| 914,655 | A | 3/1909 | Glenn |
| 941,488 | A | 11/1909 | Beckley |
| 974,970 | A | 11/1910 | Iorio |
| 1,104,069 | A | 7/1914 | Oliver |
| 1,528,661 | A | 3/1925 | Ewing |
| 1,588,337 | A | 6/1926 | Rode |
| 1,687,775 | A | 10/1928 | Lestage |
| 1,917,386 | A | 7/1933 | Meyer |
| 2,607,592 | A | 8/1952 | Finnerty |

(Continued)

OTHER PUBLICATIONS

Skip-Bo instruction sheets, 1999, http://service.mattel.com/instruction_sheets/42050.pdf.

*Primary Examiner* — Michael Dennis

(74) *Attorney, Agent, or Firm* — Sheppard, Mullin, Richter & Hampton LLP

(57) ABSTRACT

A game system may provide a plurality of cards, at least one token and a token storage and distribution system. The plurality of cards may each have at least one indicium representing a value. The token(s) may have a value that is substitutable for at least a portion of the value associated with the card. The token storage and distribution system comprises a slot for depositing the token(s) into the token storage and distribution system. The slot corresponds to a storage compartment that further comprises sub-compartments and a diverter to direct the deposited token into one of the sub-compartments. The token storage and distribution system defines one of more locations for positioning one or more build piles for the cards being played. The player may select to access one of the sub-compartments according to a rule set and acquire the token(s) present, if any, in the selected sub-compartment.

6 Claims, 7 Drawing Sheets

(56) References Cited

U.S. PATENT DOCUMENTS

| | | | | | |
|---|---|---|---|---|---|
| 2,616,699 | A | | 11/1952 | Franks | |
| 3,190,656 | A | | 6/1965 | Weisbecker | |
| 3,358,998 | A | | 12/1967 | Goldfarb | |
| 3,392,981 | A | | 7/1968 | Robertson | |
| 3,599,979 | A | * | 8/1971 | Weisbecker | A63F 9/00 273/138.4 |
| 3,610,628 | A | | 10/1971 | Promin | |
| 3,645,530 | A | | 2/1972 | Hernandez et al. | |
| 3,674,275 | A | | 7/1972 | Samson | |
| 3,797,831 | A | | 3/1974 | Glass et al. | |
| 3,861,685 | A | | 1/1975 | Trbovich | |
| 3,895,808 | A | | 7/1975 | Averette | |
| 3,918,717 | A | | 11/1975 | Charves | |
| 4,039,193 | A | | 8/1977 | Slater et al. | |
| 4,061,335 | A | * | 12/1977 | Breslow | A63F 3/00006 273/139 |
| 4,076,251 | A | | 2/1978 | Hornsby, Jr. | |
| 4,111,429 | A | | 9/1978 | Waski | |
| 4,147,352 | A | | 4/1979 | Rosero | |
| 4,205,465 | A | | 6/1980 | Mannarino | |
| 4,274,630 | A | | 6/1981 | Kulesza et al. | |
| 4,477,081 | A | | 10/1984 | Crosby | |
| 4,591,159 | A | | 5/1986 | Lehner | |
| 4,744,566 | A | | 5/1988 | Malavazos et al. | |
| 4,915,393 | A | | 4/1990 | Oliver | |
| 5,213,334 | A | | 5/1993 | Yih | |
| 5,370,391 | A | | 12/1994 | Hilzendeger et al. | |
| 5,451,062 | A | | 9/1995 | Malone | |
| 5,713,572 | A | | 2/1998 | Hagiwara | |
| 6,164,652 | A | | 12/2000 | Lauretta et al. | |
| 6,209,868 | B1 | | 4/2001 | Norton | |
| 6,402,144 | B1 | | 6/2002 | Ekberg | |
| 6,598,880 | B2 | | 7/2003 | Addabbo | |
| 6,682,420 | B2 | | 1/2004 | Webb et al. | |
| 6,863,275 | B2 | | 3/2005 | Chiu et al. | |
| 8,387,981 | B2 | | 3/2013 | Caron | |
| 2004/0075214 | A1 | | 4/2004 | Roberts | |
| 2005/0035549 | A1 | | 2/2005 | Zeng | |
| 2006/0097451 | A1 | | 5/2006 | Callaway | |
| 2011/0215527 | A1 | | 9/2011 | Shelley et al. | |

* cited by examiner

GAME ASSEMBLY COMPRISING A TOKEN SUBSTITUTE FEATURE AND A TOKEN STORAGE AND DISTRIBUTION SYSTEM

CROSS-REFERENCE TO RELATED APPLICATIONS

This application claims the benefit under 35 U.S.C. §119 of U.S. Provisional Application No. 61/933,240, filed Jan. 29, 2014, the entire contents of which are incorporated herein by reference as if fully set forth herein.

FIELD OF THE INVENTION

The present invention generally relates to games and, more particularly, to games with a token substitute feature and a token storage and distribution system.

BACKGROUND

Card games are a popular form of diversion and entertainment. Many card games require two or more players and a game play that is based on the value of the card being played. The winner is determined based achieving a winning condition of the game, such as, for example, building a card pile in sequence until a player plays all the cards in his or her possession. There are numerous variations of such card play, depending on the how the cards are arranged and distributed to the players, and also depending on the game's rule for drawing, exchanging and discarding cards.

Game play based solely on a deck of cards may be limited when a player does not have one or more cards having the required value for continued game play. In such circumstances, the rules for game play typically call for exchanging or drawing additional cards to permit continued game play until one or more player achieves a winning condition.

BRIEF SUMMARY

Various embodiments of a game system are described herein. The game system may include a plurality of cards and one or more tokens, which may be played as a substitute for a card with a card value during card play. The cards may be played according to predetermined constraints or rules. When a player is unable or unwilling to play an eligible card under one of the constraints or rules, the player may elect to use one or more tokens in his or her possession to represent the value associated with the eligible card in substitution of playing the eligible card itself. In some exemplary embodiments, the tokens may be stored in a container and an element of game play may be enhanced by keeping some amount of tokens available for play hidden. In other exemplary embodiments, an additional element of game play may include providing a decision making situation by having a player select a sub-compartment of a storage area from a plurality of sub-compartments in the container. The selected sub-compartment may include tokens that have been diverted to that sub-compartment from one or more of the other sub-compartments based on an internal structure of the container. As can be seen, enjoyment and further strategy may be added to game play involving cards by introducing a feature which may allow more card play when a player does not have certain cards for continued game play.

In one embodiment, a game system comprises a plurality of cards, at least one token and a token storage and distribution system. The plurality of cards each have at least one indicium representing a value. The at least one token has a value that is substitutable for at least a portion of the value associated with the card. The token storage and distribution system comprises a slot for depositing the at least one token into the token storage and distribution system, the slot corresponding to a storage compartment that further comprises sub-compartments and a diverter to direct the deposited token into one of the sub-compartments. The token storage and distribution system defines one of more locations for positioning one or more build piles for the cards being played.

In another embodiment, a method of providing a card-and-token game is described. A plurality of cards is provided to two or more players, the cards each having a value. A token storage and distribution system is provided. The token storage and distribution system comprises a slot that corresponds to a storage compartment comprising sub-compartments and a diverter. The diverter directs a token deposited into the slots into one of the sub-compartments. The sub-compartments each have separate covers concealing an interior of the sub-compartments. A rule set is provided according to which the players play one or more of the plurality of cards based on the value associated with the cards and according to which the players may deposit one or more tokens in the token storage and distribution system instead of playing one or more of the plurality of cards based on a combined value of the one or more tokens having the value of the card that is required to be played according to the rule set.

In a further embodiment, a game system is described. The game system comprises a token storage and distribution system having a housing that comprises a central portion and a plurality of storage compartments disposed radially from the central portion and having a peripheral edge distal to the central portion. A plurality of slots is disposed in the central portion, the plurality of slots each corresponding to one of the plurality of storage compartments. Sub-compartments are provided within each one of the plurality of storage compartments. The sub-compartments each have separate covers. The token storage and distribution system further comprises one or more diverters. When a token is deposited into one of a the plurality of storage compartments through the corresponding slot, the one or more diverters direct the token into one of the sub-compartments within the storage compartment. The covers may be movable between open and closed configurations to reveal and conceal the contents of the corresponding sub-compartments, respectively.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Illustrative embodiments of the present disclosure are described herein with reference to the accompanying drawings, in which.

Like numerals refer to like parts throughout the several views of the drawings.

DETAILED DESCRIPTION OF THE EXEMPLARY EMBODIMENTS

Specific, non-limiting embodiments of the present invention will now be described with reference to the drawings. It should be understood that such embodiments are by way of example only and merely illustrative of but a small number of embodiments within the scope of the present invention. The description is not to be taken in a limiting sense, but is made merely for the purpose of illustrating the general principles of the invention. Various inventive features are described below that can be used independent of one another or in combination with other features. Various changes and modifications obvious to one skilled in the art to which the present invention pertains are deemed to be within the spirit, scope and contemplation of the present invention as further defined in the appended claims.

Figure 1:
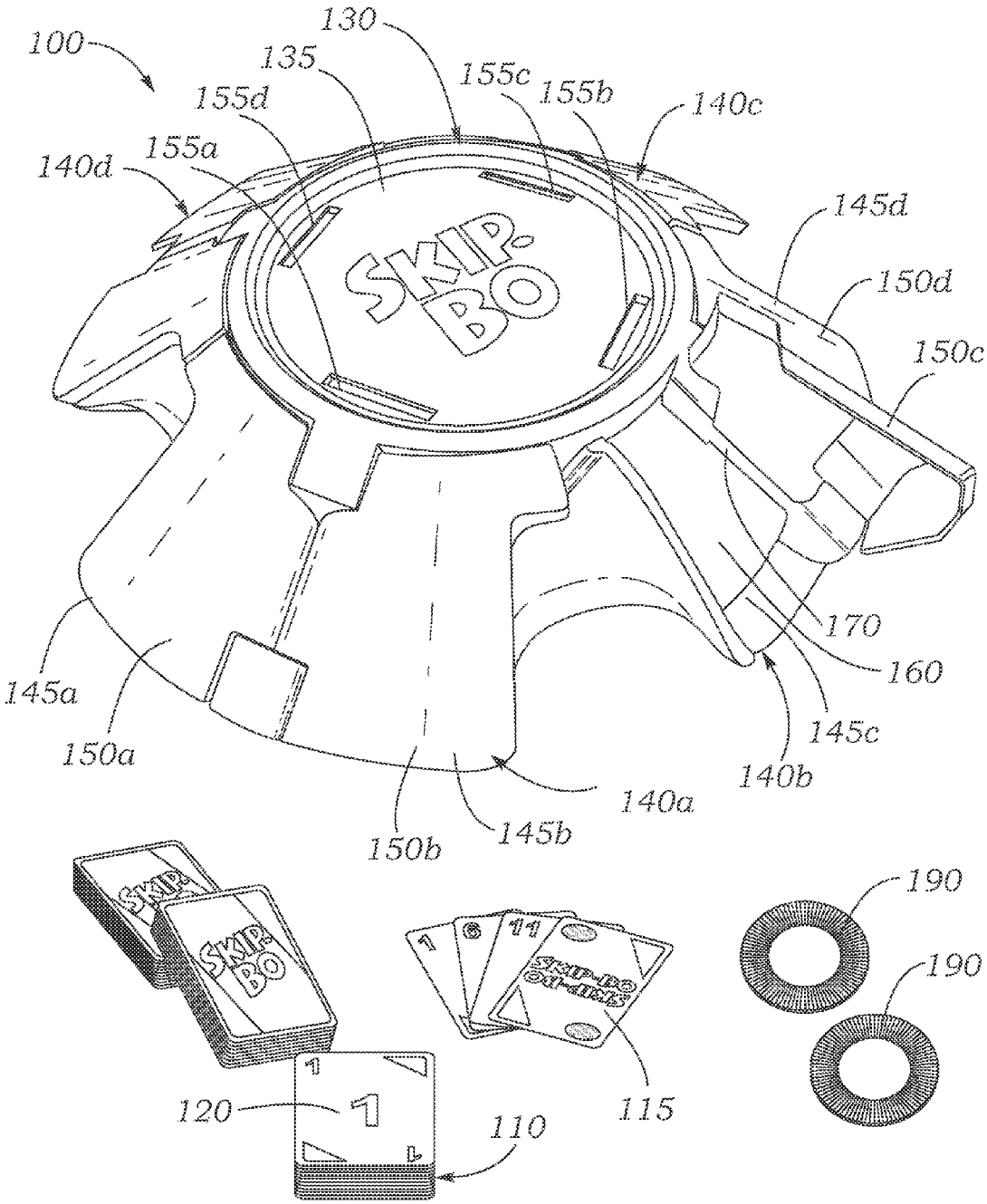
FIG. 1 is a perspective top view of a card game system in accordance with an exemplary embodiment.

Referring now to FIG. 1, a game system 100 is shown according to one exemplary embodiment. The game system 100 may include a deck 110 of cards 115 and one or more tokens 190. Each card 115 may include an indicium 120 representing a card value. In the illustrated embodiment, the indicium 120 of "1" represents a card value of "1". In other examples, an indicium 120 of "6" may represent a card value of "6", etc. In some exemplary embodiments, the token(s) 190 are played to represent a card value equivalent to the value associated with a card 115. In some embodiments, the token(s) 190 may have a single unit value and more than one token 190 may be needed to represent the value associated with a card 115 that should be played. For example, if a desired card value is "5", a player may be required to play five tokens as a substitute for playing a card with an indicium of "5". In other embodiments, each token may also have an indicium representing a value. For example, if a desired card value is "5", a player may play one token with an indicium of "2" and a second token with an indicium of "3" as a substitute for playing a single card with an indicium of "5". The token 190 may be, for example, a chip as shown; however, it will be understood that other items may serve as tokens. For example, balls, dice, and other items that are not necessarily a card may serve as tokens. In an exemplary embodiment, a number or value may be reflected as a number provided on the token 190 or as a color representing a value.

In some exemplary embodiments, the game system 100 includes a token storage and distribution system 130. Tokens 190 may be stored in the token storage and distribution system 130 during play. In some embodiments, a player may play a card 115 with an indicium that indicates a grant of access to the token storage and distribution system 130 to withdraw token(s) 190.

The token storage and distribution system 130, as illustrated, includes a housing 135 that houses a plurality of storage compartments 140 (designated as 140*a*, 140*b*, 140*c*, and 140*d*). The number of storage compartments 140 may be based on a maximum number of players for the game. For example, a game with a maximum of four players may use a token storage and distribution system 130 with four storage compartments 140. Typically, at least two players may engage in game play during a session. Tokens 190 may be inserted into slots 155*a*, 155*b*, 155*c*, and 155*d* of the housing 135 which, as illustrated, correspond to respective storage compartments 140*a*, 140*b*, 140*c*, and 140*d*. In some exemplary embodiments, the storage compartments 140*a*, 140*b*, 140*c*, and 140*d* are opaque so that the tokens 190 inside the storage compartments 140*a*, 140*b*, 140*c*, and 140*d* may be hidden from the players' views. An additional element of game play may be provided by dividing the storage compartments 140*a*, 140*b*, 140*c*, and 140*d* into sub-compartments (generally designated by 145). The sub-compartments 145 may be concealed by a cover 150. The cover 150 may be, for example, a door or hinged panel. However, other exemplary embodiments may include, for example, a drawer and handle combination (not shown). The cover 150 may provide one or more players with selective access to its corresponding sub-compartment 145 or storage compartment 140. The storage compartment 140*a* is shown with both sub-compartments 145*a* and 145*b* concealed by covers 150*a* and 150*b*. The storage compartment 140*b* is shown with the interior of the sub-compartment 145*c* exposed (the cover 150*c* is swiveled open) and the interior of sub-compartment 145*d* concealed (the cover 150*d* is swiveled closed). The interior of sub-compartments 145 may include a floor 160 upon which the token(s) 190 may rest. In some embodiments, the floor 160 may slope downward commencing from below the slots 155 down to a bottom extremity of the sub-compartment 145. The downward slope may aid in moving a token 190 dropped from the slot closer to a cover 150, and thus make the token 190 more readily accessible to a player accessing the sub-compartment 145. In some embodiments, a diverter 170 may divide the storage compartments 140 into the sub-compartments 145. The slots 155*a*, 155*b*, 155*c*, and 155*d* may be positioned over respective diverters 170. The diverters 170 may be disposed to randomly deflect the tokens 190 into the sub-compartments 145.

Referring to FIGS. 2-6 which follow, a game system 200 is shown according to another exemplary embodiment. The game system 200 is similar to the game system 100 except that the token storage and distribution system 230 includes a generally cubic appearance, among other features, in comparison to the token storage and distribution system 130. Elements of the token storage and distribution system 230 that are analogous or similar to elements of the token storage and distribution system 130 are designated with a "200" series number for ease of reference.

Figure 2:
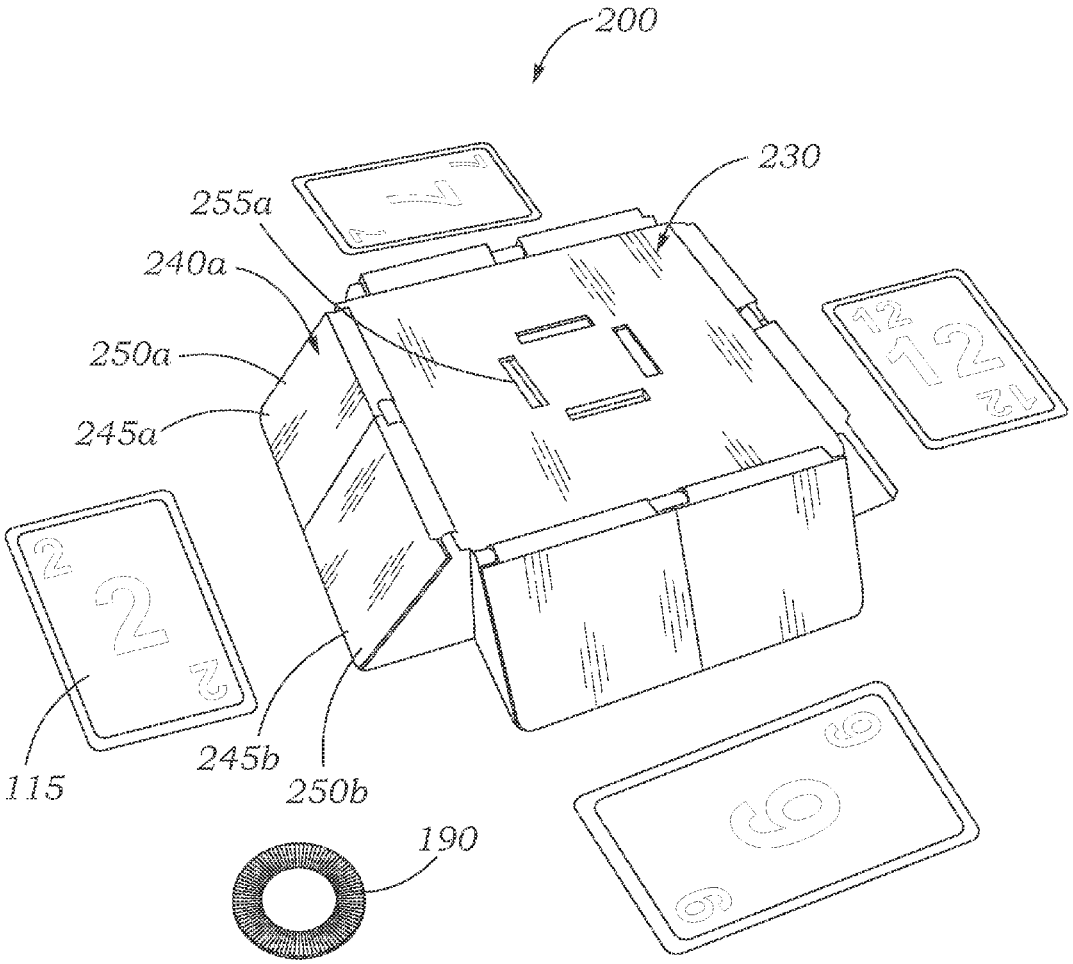
FIG. 2 is a perspective top view of a card game system in accordance with another exemplary embodiment.

In FIG. 2, the token storage and distribution system 230 is shown concealing one or more tokens 190. For example, a token 190 has been inserted into slot 255*a*. The token storage and distribution system 230 may be configured to randomly direct the token 190 into either the sub-compartment 245*a* or the sub-compartment 245*b* of the storage compartment 240*a*. Thus, in some exemplary embodiments, the sub-compartment 245*a* and the sub-compartment 245*b* each contain a different number of tokens 190. However, during game play, the covers 250*a* and 250*b* may conceal from a player in which sub-compartment (245*a* or 245*b*) the token(s) 190 has landed and, consequently, which sub-compartment (245*a* or 245*b*) has more tokens 190. Thus, the number of token(s) that may be in each of sub-compartments 245*a* and 245*b* remains unknown to the player until at least one of the covers 250 and 250*b* is opened. As may be appreciated, the random distribution of tokens 190 into the sub-compartment 245*a* or the sub-compartment 245*b* may add an element of risk and reward to game play when the player decides which cover 250*a* or 250*b* should be opened to reveal the number of tokens 190 which may be gained.

Figure 3:
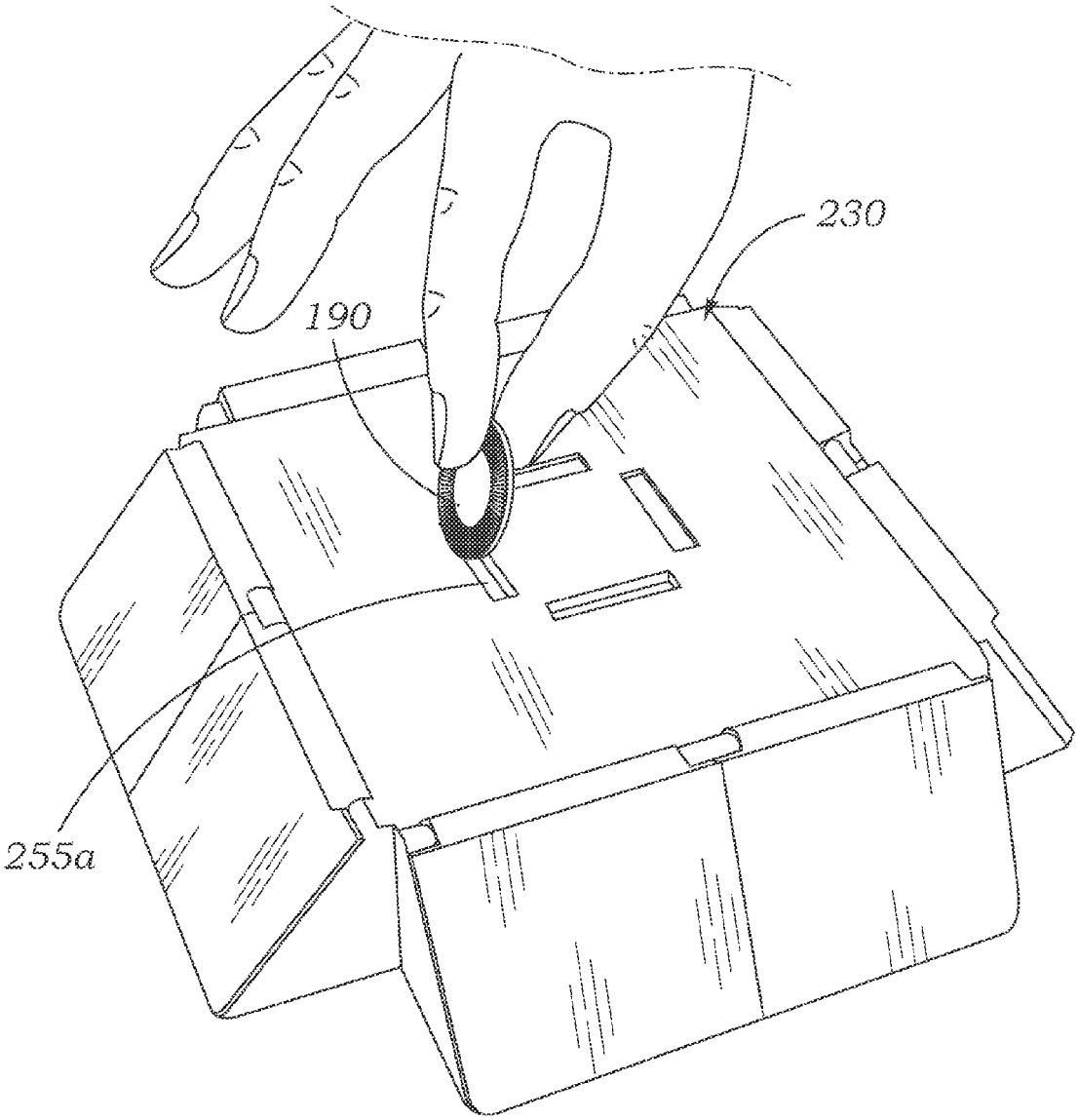
FIG. 3 is a perspective top view of a user inserting a token into the token storage and distribution assembly of the system of FIG. 2.
Figure 4:
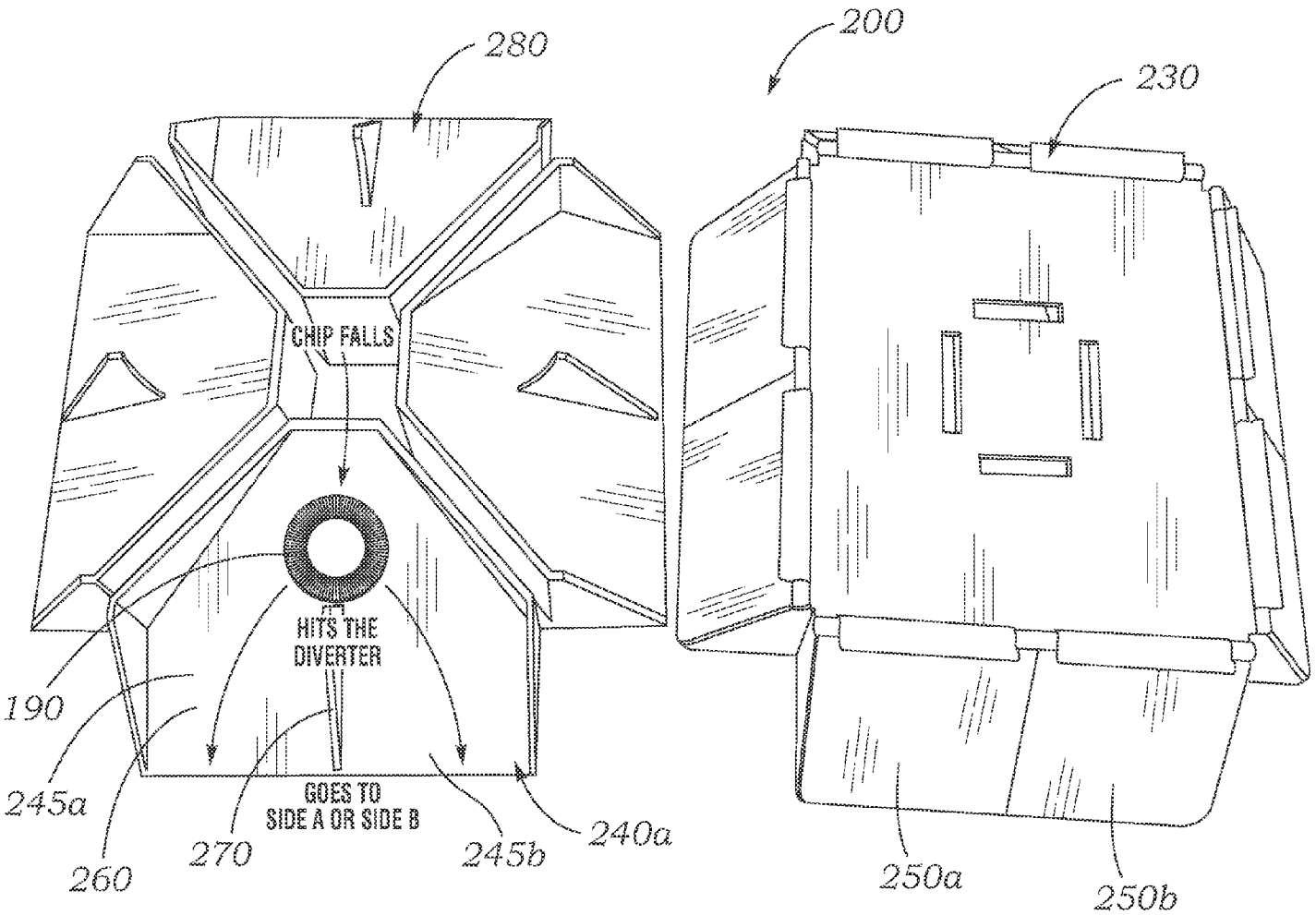
FIG. 4 is a top view of the token storage and distribution assembly of the system of FIG. 3 shown disassembled.

Referring now to FIGS. 3-4, the interior of the token storage and distribution system 230 (FIG. 4) is shown after a token 190 is inserted through a slot 255*a* (FIG. 3) in accordance with another exemplary embodiment. For sake of illustration only (in FIG. 4), a single storage compartment 240*a* is described in detail with numerals designating elements of the storage compartment. However, it will be understood and it can be inferred from the remainder of FIG. 4 that each storage compartment 240 may include the same features and the distribution of tokens 190 may occur in whichever storage compartment 240 corresponds to the slot 255 receiving the token 190. The token storage and distribution system 230 may include a diverter assembly 280 configured to direct the token 190 into either the sub-compartment 245*a* or the sub-compartment 245*b*. The diverter assembly 280 may be configured so that each storage compartment 240 may include a diverter 270 dividing the floor 260 of the storage compartment 240 into substantially equal halves. Thus, as tokens 190 are inserted into the token storage and distribution system 230, the tokens 190 may randomly accumulate in one or more of the sub-compartments.

Figure 5:
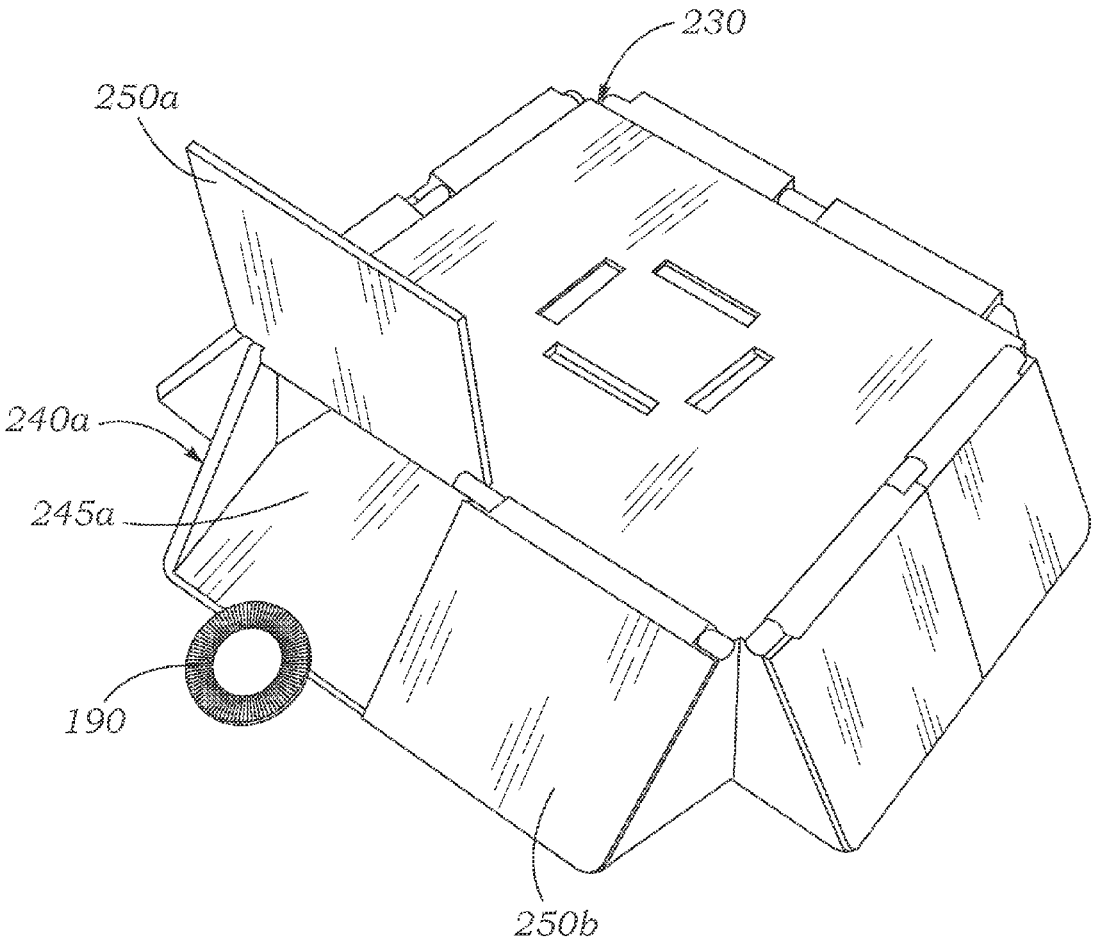
FIG. 5 is a perspective top view of an opened compartment door exposing a hidden token in the token storage and distribution assembly of the system of FIG. 3.
Figure 6:
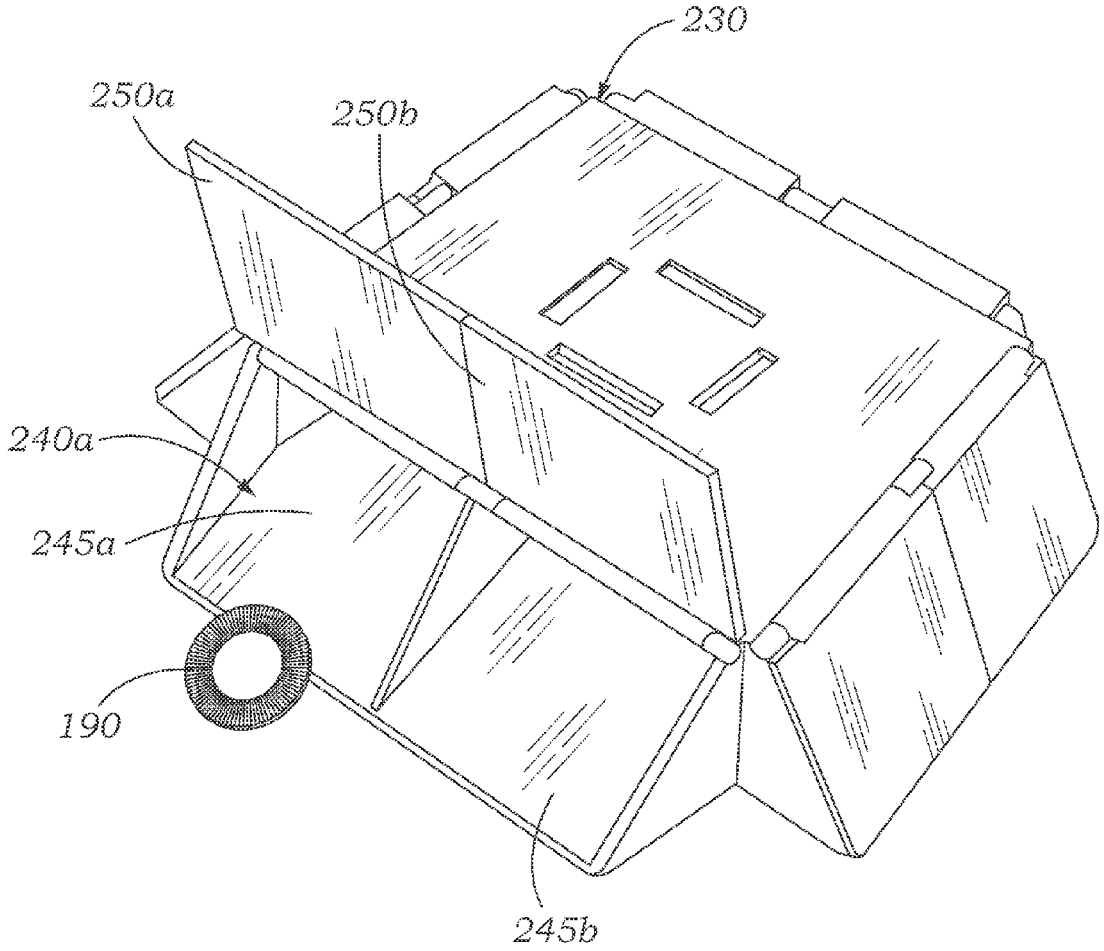
FIG. 6 is a perspective top view of one sub-compartment including a token and one sub-compartment without a token in the token storage and distribution assembly of the system of FIG. 3.

Referring now to FIGS. 5-6, an exemplary result of inserting the token 190 into the slot 255*a* (FIG. 3) is shown. The token 190 landed in the sub-compartment 245*a* after having encountered the diverter 270 (FIG. 4). During game play, if a player chooses to open the cover 250*a*, the token 190 inside the sub-compartment 245 is revealed. However, as seen in FIG. 6, if the player chooses to open cover 250*b*, the sub-compartment 245*b* may be revealed as being empty.

Figure 7:
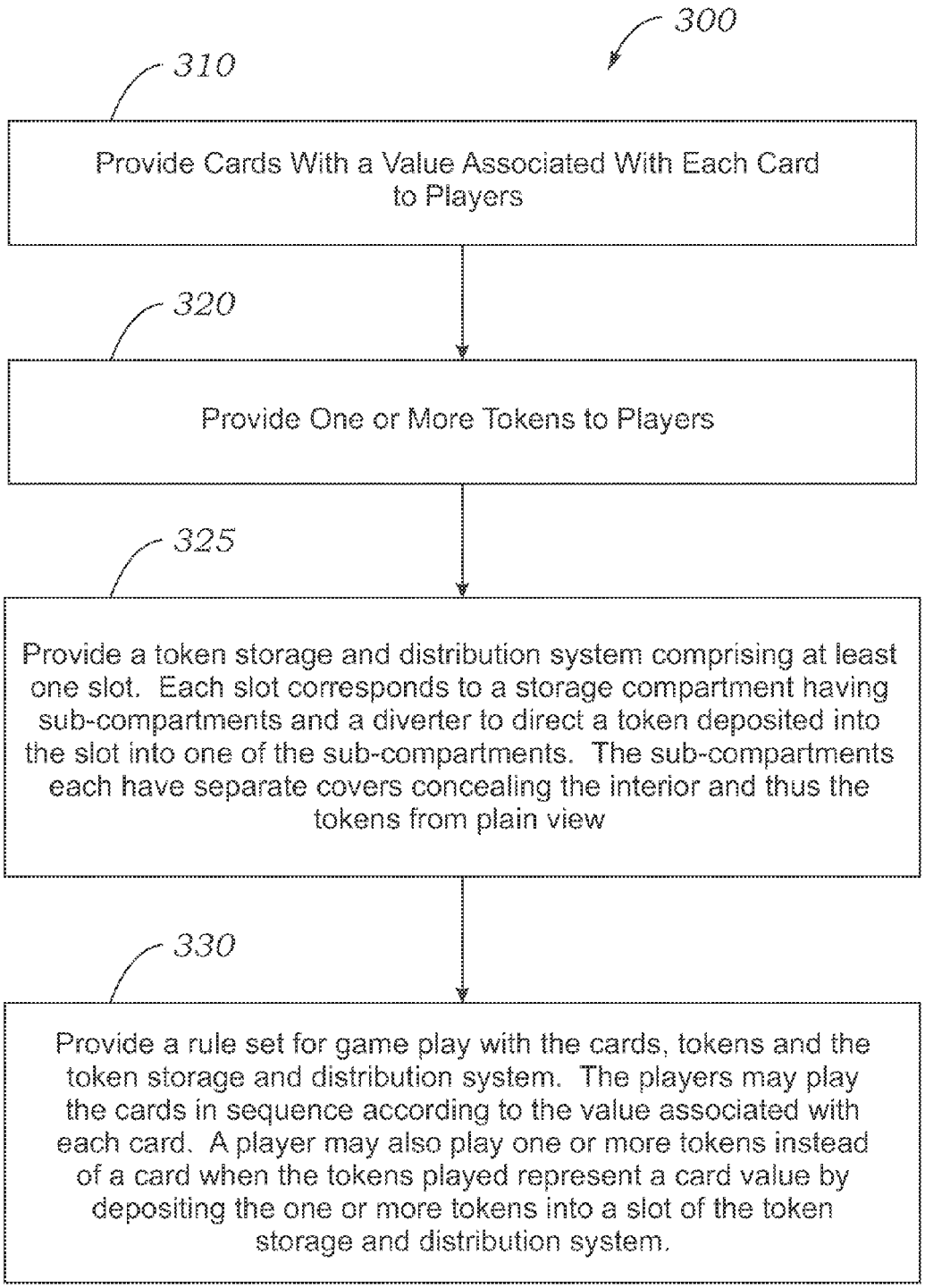
FIG. 7 is a flow chart of a method of game play using a token with cards in accordance with another exemplary embodiment.

FIG. 7 illustrates an exemplary method 300 of game play in accordance with the exemplary embodiments disclosed herein. The method 300 may be used, for example, in cooperation with the game system 100 of FIG. 1.

Players may generally be positioned in front of their respective storage compartment 140. Game play may begin with a card 115 face-up in front of each storage compartment 140. These cards 115 may be the starting cards 115 of four communal building piles where players play cards 115 from their respective hands. In block 310, a dealer may deal each player a set number of cards 115 (for example, fifteen) face down. The cards 115 dealt to each player may comprise each player's stockpile. The dealer may then deal each player a set number of cards (for example, five) which may comprise the player's hand. The remaining cards 115 may form a draw pile. In block 320, each player may be provided with a set number of tokens 190 (for example, eight). In block 325, a token storage and distribution system 130 is provided. The token storage and distribution system 130 comprises at least one slot 155 which corresponds to a storage compartment 140. The storage compartment 140 has sub-compartments 145 and a diverter 170 to direct a token 190 deposited into the slot 155 into one of the sub-compartments 145. The sub-compartments 145 each have separate covers 150 concealing the interior and thus the tokens 190 contained therein from plain view. In block 330, players may take turns placing cards 115 from their hand or from the top of their stockpile onto one of the communal building piles. In some embodiments a player may play a plurality of cards 115 during a single turn until the player no longer has an eligible move to make. In other embodiments, each player may play one eligible move per turn. In other embodiments, a player may play to the pile in front of him or her. In other embodiments, the player may play to any communal building pile where he or she may play an eligible card 115. An eligible card 115 to be played may be a card with the next value in sequence corresponding to the build pile being played. For example, cards 115 may be played in ascending numerical order commencing with the next number higher than the value of the top card on the build pile. The first player to play all the cards 115 in their stockpile may win.

In the event a player does not have an eligible card 115 in their hand that they can play, they may use the tokens 190 to represent the next eligible card 115 that should be played. Under an exemplary embodiment, the player may place the number of tokens 190 equaling the value of the card to be played into the slot 155 of the token storage and distribution system 130. Generally, the slot 155 that receives the tokens 190 may correspond to the discard pile being played. The player may then play the card 115 having the next higher value in the sequence after the token value that was deposited. For example, if a card 115 is showing a "4" on the build pile, the player may elect to deposit five tokens 190 and then place a card 115 showing a "6" on top of the build pile.

Under an exemplary embodiment, the deck 110 may include one or more cards 115 that may be designated as a "token" card. The "token" card may grant the player a chance to acquire more tokens 190. For example, the "token" card may permit the player access to the token storage compartment 140. The player may decide which cover 150 to open revealing any tokens 190 in the corresponding sub-compartment 145. In some cases, because of the random distribution of tokens 190 by the diverter 170, there may be no tokens 190 in the selected sub-compartment 145. Any tokens 190 that are present in the sub-compartment 145 may be added to the player's token holdings and may be played according to the above rule set.

In the event a player does not have the next eligible card 115, enough tokens 190 to play, a "token" card, or has discarded all of their hand, then the player's turn may end and play may pass to the next player.

In another exemplary example, game play may be used in cooperation with a system including one hundred and twelve cards, one token storage and distribution system, four tokens of a first color and forty tokens of a second color.

Game set up includes placing the token storage and distribution system in the center of a play area. Each player is assigned a storage compartment. A predetermined number of tokens, for example three tokens, of a second color are placed in each slot corresponding to a player's storage compartment. A card dealer places a card face up in front of each player's storage compartment to represent the start of a communal building pile. The dealer deals each player a stockpile of a pre-determined number of cards, for example, fifteen cards, face down. The dealer then flips the top card on each stockpile face up. The dealer deals each player a hand of another pre-determined number of cards, for example, five cards. The dealer places the remaining cards face down near the storage compartment to form a draw pile. The dealer distributes predetermined numbers of tokens of various colors representing different values to each player, for example, one token of a first color and seven tokens of the second color to each player. The remainder of tokens are removed from being played in the game completely.

A player is selected to start the game. During each player's turn, the player may play as many cards from their hand or the top card of their stockpile to any of the communal building piles. When a player plays the top card of their stockpile, the next card down in the stockpile is flipped face up to become the new top card. A player may play a card only if it includes an indicium representing a numerical value that is the next highest numerical value from the numerical value of the card on top of the communal building pile. For example, a card with an indicium of "10" may be played on top of a card with an indicium of "9". A wild card may be used in lieu of a card with a particular indicium. When the top card of a communal building pile reaches a particular numerical value, for example "12", that building pile may be cleared, and the cards are placed in a discard pile. A new communal building pile may be started at the location of the previous pile. If a player plays all five cards from their hands in a single turn, that player draws another five cards from the draw pile and continues their turn. At the end of a player's turn, such as when the player can no longer play a card from either their hand or the top of their stockpile, the player discards one card to the discard pile and draws cards from the draw pile until their hand includes five cards.

During a player's turn, the player may use tokens in lieu of playing a card. For example, the player may place tokens with a value corresponding to the next highest numerical value from the numerical value of the card on top of a communal building pile into a slot corresponding to that building pile. The player then must play a card with an indicium representing the next numerical value in sequence after the numerical value of the tokens played. For example, where a card with an indicium of "4" is on top of a building pile and a player holds a card with an indicium of "6" in their hand, the player may place five tokens in the slot closest to the building pile and then play the "6" card onto the building pile from their hand.

Select cards may additionally include a token retrieving indicium. For example, two of each set of cards with a particular numerical value may include the token retrieving indicium. When a player plays a card bearing the token retrieving indicium, the player may select one of the sub-compartments corresponding to their storage compartment. The selection may be accomplished by opening a door or hinged panel, for example. The selection may make tokens available to the player that then becomes in possession of and subsequently playable by the player. For example, opening the door may reveal a number of tokens inside the sub-compartment. The players continue to take turns until one of the players meet a winning condition. For example, the first player to play all of the cards in their stockpile may be considered the winner.

It should be understood, of course, that the foregoing relates to exemplary embodiments of the invention and that modifications may be made without departing from the spirit and scope of the invention as set forth in the following claims.

What is claimed is:

1. A game system comprising:

a token storage and distribution system comprising a central portion and a plurality of storage compartments disposed radially from the central portion and having a peripheral edge distal to the central portion;

a plurality of slots disposed in the central portion, the plurality of slots each corresponding to one of the plurality of storage compartments;

sub-compartments within each one of the plurality of storage compartments, the sub-compartments each having separate covers; and one or more diverters;

wherein when a token is deposited into one of a the plurality of storage compartments through the corresponding slot, the one or more diverters direct the token into one of the sub-compartments within the storage compartment; and wherein the covers are movable between open and closed configurations to reveal and conceal the contents of the corresponding sub-compartments, respectively.

2. The game system of claim 1, wherein the diverters are disposed in the storage compartments and wherein the diverters divide the storage compartments into sub-compartments.

3. The game system of claim 1, wherein the slots are positioned over the diverters.

4. The game system of claim 1, wherein the sub-compartments each comprise a floor that slopes downwardly from below the slots to the peripheral edge.

5. The game system of claim 1, wherein the covers are one or more selected from the group consisting of: a door, a hinged panel and a drawer and handle.

6. The game system of claim 1, further comprising a deck of cards, a plurality of tokens and a rule set for game play.

* * * * *